US007690191B2

(12) United States Patent
Dean et al.

(10) Patent No.: US 7,690,191 B2
(45) **Date of Patent: *Apr. 6, 2010**

(54) FUEL PRECONDITIONING FOR DETONATION COMBUSTION

(75) Inventors: Anthony John Dean, Scotia, NY (US); Ivett Alejandra Leyva, Playa Del Rey, CA (US); Chukwueloka Obiora Umeh, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 594 days.

This patent is subject to a terminal disclaimer.

(21) Appl. No.: 11/326,718

(22) Filed: Jan. 6, 2006

(65) Prior Publication Data

US 2007/0157623 A1 Jul. 12, 2007

(51) Int. Cl.
*F02K 5/02* (2006.01)

(52) U.S. Cl. ..... 60/247; 60/39.38; 60/39.76

(58) Field of Classification Search ..... 60/39.38, 60/39.39, 723, 39.76–39.79, 247; 431/1
See application file for complete search history.

(56) References Cited

U.S. PATENT DOCUMENTS

| | | | | |
|---|---|---|---|---|
| 3,615,850 | A | 10/1971 | Chludzinski | |
| 5,513,489 | A | 5/1996 | Bussing | |
| 5,672,184 | A | 9/1997 | Hunter | |
| 6,062,018 | A | 5/2000 | Bussing | |
| 6,666,018 | B2 * | 12/2003 | Butler et al. | 60/226.1 |
| 2003/0136108 | A1 * | 7/2003 | Meholic et al. | 60/204 |
| 2004/0112060 | A1 * | 6/2004 | Kraft | 60/776 |
| 2004/0265214 | A1 * | 12/2004 | Anderson | 423/579 |
| 2005/0109010 | A1 * | 5/2005 | Dean et al. | 60/39.76 |

FOREIGN PATENT DOCUMENTS

| | | | |
|---|---|---|---|
| JP | 2005255494 A | * | 9/2005 |
| RU | 2034996 C1 | * | 5/1995 |

OTHER PUBLICATIONS

M. Cooper et al., "Experiments Studying Thermal Cracking, Catalytic Cracking, and Pre-Mixed Partial Oxidation of JP-10", 39$^{TH}$ AIAA/ASME/SAE/ASEE Joint Propulsion Conference and Exhibit, Jul. 20-23, 2003, Huntsville, AL., pp. 1-20.

* cited by examiner

*Primary Examiner*—Michael Cuff
*Assistant Examiner*—Phutthiwat Wongwian
(74) *Attorney, Agent, or Firm*—Francis T. Coppa

(57) ABSTRACT

A fuel preconditioning system for use with a pulse detonation combustor (PDC) makes use of a heat source to pyrolyze fuel prior to injecting it into the PDC for detonation. The fuel is decomposed into a more detonable form by pyrolysis in a conditioner that applies heat to the fuel in the absence of oxidizer. The heat may be provided by a hot section of the engine, including the walls of the PDC itself. The conditioned fuel is fed to the PDC and detonated.

20 Claims, 3 Drawing Sheets

FUEL PRECONDITIONING FOR DETONATION COMBUSTION

BACKGROUND OF THE INVENTION

This invention relates to propulsion or power systems utilizing detonative combustion for energy conversion, that use liquid hydrocarbon fuels, and more particularly to a fuel preconditioning system for use with detonation-based propulsion and power systems.

Detonation based combustion systems can be used in place of ordinary combustors to enhance the performance of certain systems. Because many fuels that one might want to use in such systems, such as aviation fuels, consist of a range of relatively heavy hydrocarbons that do not readily detonate, relatively high detonation initiation energy is required for detonation. In a similar manner, known natural gas fuels, which are primarily methane, are not readily detonable compared to other known fuels. To facilitate enhanced detonation, at least some known detonation systems mix oxygen with the fuel to create a more detonable mixture that is ignited in a detonation initiator chamber. Although the initiator chamber creates an over-driven detonation that initiates a fuel-air mixture detonation in the detonation chambers, such systems require the addition of oxygen tanks or oxygen generation systems, and as a result, any benefits gained from using such pulse detonation systems may be offset by the weight gain to the system.

Therefore, there is a continued need for techniques to enable the use of hydrocarbon fuels in detonation based combustion systems.

BRIEF SUMMARY OF THE INVENTION

In one embodiment of the method described herein, a pulse detonation chamber in a gas turbine engine is operated by routing fuel to a fuel conditioner that is coupled in flow communication with a detonation chamber. The fuel is converted into hydrocarbon fragments within the fuel conditioner using at least one of a pyrolysis process and a catalysis process. The fuel is routed from the fuel conditioner to the detonation chamber. Air is channeled into the detonation chamber to mix with the fuel, and the fuel/air mixture is detonated within the detonation chamber.

In one embodiment of a detonation system for an engine as described herein, a detonation chamber for detonating a fuel/air mixture is provided. A fuel conditioner is coupled in flow communication to said detonation chamber, and the fuel conditioner is configured to convert fuel to hydrocarbon fragments using at least one of a pyrolysis process and a catalysis process.

DETAILED DESCRIPTION OF THE INVENTION

Figure 1:
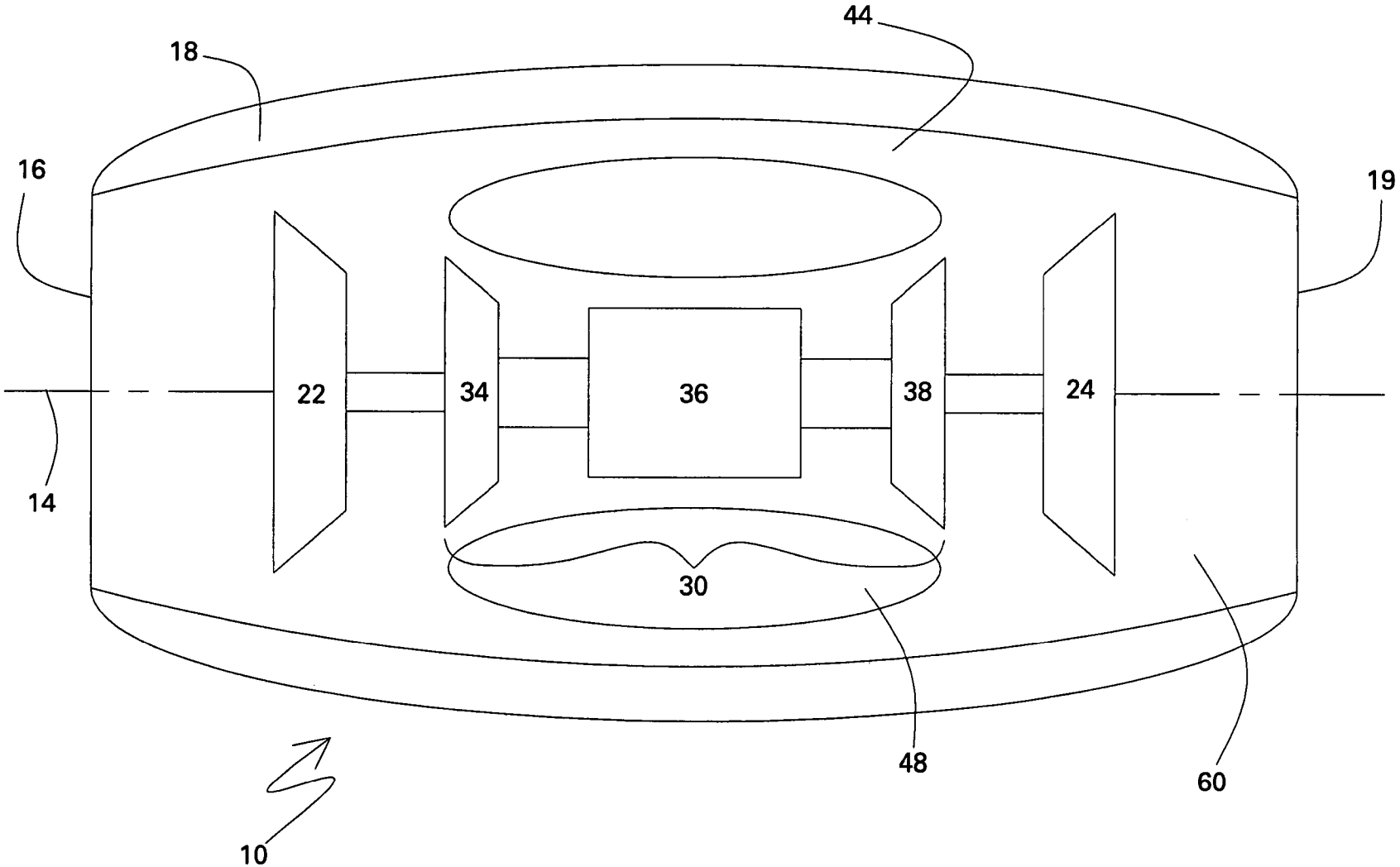
FIG. 1 is a cross-sectional schematic side view of an exemplary engine.

Pulse detonation engines combust a fuel and oxidizer mixture, producing hot combustion gases, which have increased temperature and pressure. However, unlike a deflagration, detonation produces a rise in the pressure of the combustion products (compared to the reactants) and results in a shockwave front that is coupled to the combustion reaction zone. This shockwave propagates through the detonating mixture of fuel and oxidizer at supersonic speeds. Unlike ordinary deflagration, which does not produce a rise in the pressure of the combustion products, detonation requires certain conditions in the combustion reactants in order for a detonation to form and propagate. Conditions that help to produce a detonation in a fuel/air mixture, or to support the continuing propagation of the detonation wave include, but are not limited to: the temperature of the detonating mixture; the fuel state (gaseous, liquid or mixed-phase); the fuel particle size (if using liquid fuel droplets); the stoichiometry of the mixture; the uniformity of the mixture; and the chemical composition of the fuel, including its average molecular weight.

In particular, liquid fuels are generally more difficult to detonate than gaseous fuels. In order to operate with more commonly available liquid fuels, it is desirable to find ways to enhance the ability of a combustion system to detonate sprays of liquid fuels, or fuel having a mix of liquid and gaseous phases. Exemplary liquid fuels that may be used with the systems and techniques described herein can include, but are not limited to: gasoline and distillate fuels, such as kerosene, JP8 and diesel. Various techniques described herein will address ways to alter one or more of the general properties of the fuel or fuel/oxidizer mixture mentioned above, in a way that enhances the detonability of the mixture.

As used herein, a "pulse detonation combustor" (PDC) will be used to refer broadly to any device or system that produces both a pressure rise and velocity increase from a series of repeating detonations or quasi-detonations within the device. A "quasi-detonation" is a supersonic turbulent combustion process that produces a pressure rise and velocity increase higher than the pressure rise and velocity increase produced by a deflagration wave. Embodiments of PDCs include a means of igniting a fuel/oxidizer mixture, for example a fuel/air mixture, and a detonation chamber, in which pressure wave fronts initiated by the ignition process coalesce to produce a detonation wave.

Each detonation or quasi-detonation can be initiated either by external ignition, such as spark discharge or laser pulse, or by gas dynamic processes, such as shock focusing, autoignition or by another detonation (cross-fire). The geometry of the detonation chamber is such that the pressure rise of the detonation wave expels combustion products out the PDC exhaust to produce a thrust force. Pulse detonation can be accomplished in a number of types of detonation chambers, including detonation tubes, shock tubes, resonating detonation cavities and annular detonation chambers. As used herein, the term "tube" includes pipes having circular or non-circular cross-sections. Exemplary tubes include cylindrical tubes, as well as tubes having polygonal cross-sections, for example hexagonal tubes.

One way to help facilitate the production of detonations in liquid fueled PDCs is to alter the fuel from its original form into a form that is more conducive to detonation. As noted above, various types of modifications can be made to the fuel or fuel/oxidizer mixture to accomplish this. For example, one technique is to reduce the size of the liquid droplets in the fuel spray. When the fuel is altered chemically in order to enhance the detonability of the fuel, this process will be referred to herein as 'preconditioning'. In general, preconditioning is the chemical conversion of some or all of the fuel into chemicals that are easier to detonate, or into chemicals whose presence will enhance the detonability of the fuel.

In one embodiment, preconditioning of the fuel involves converting the fuel into chemicals that have a lower average molecular weight. Such a technique can be effective when the base fuel is a hydrocarbon with a relatively long chain length. By breaking this hydrocarbon down into several smaller hydrocarbon molecules, the fuel becomes easier to detonate. Those of skill in the art will recognize that molecular weight is not the only factor that has an effect on detonability, and that other chemical modifications are also possible to enhance detonability. In addition, the preconditioning of the fuel to have a lower molecular weight may also have effects on the effective stoichiometry and physical characteristics (such as droplet size or physical state) of the fuel. Techniques and systems for such conversion will be discussed below.

In one embodiment, a liquid fuel, for example jet fuel, is preconditioned by pyrolysis. Pyrolizing the fuel involves applying heat to the fuel with a stoichiometric undersupply of oxidizer. In some applications, no oxidizer is present at all. Because no oxidizer is present, the fuel does not burn, but instead decomposes to form combustible molecules of lower molecular weight. This results in a fuel that is more detonable compared to the original fuel. The pyrolysis process also can produce radicals within the fuel, which can enhance the detonation process without increasing the $CO_2$ emissions of the burned fuel.

While heat can be applied by a number of techniques (which will be discussed in greater detail below), such an application of heat has the additional benefit that it can vaporize some or all of the fuel. This can be beneficial when the vapor form of the fuel is more easily detonable than the suspension of liquid droplets of fuel.

Once pyrolyzed, the preconditioned fuel can be fed to the PDC in order to be detonated. By providing a fuel that more easily supports detonation, detonations can be achieved in less run-up time and with detonation tubes in the PDCs that are shorter. This can help the system achieve higher pulse rates for the detonations, as well as enabling the system to operate on fuels that might ordinarily not detonate in the particular configuration of given PDC.

In another embodiment of a preconditioning process, catalysts can be used to assist in the decomposition of the fuel into a more advantageous form. A catalyst is a substance that accelerates or enables a chemical reaction, but does not get consumed or transformed in the reaction. By treating the fuel with a catalyst, the decomposition of the fuel that is performed by pyrolysis can be enhanced or accelerated in order for a larger fraction of the fuel to be effectively transformed into a more detonable form.

Various forms of catalyst can be used, including additives that are mixed with the fuel, as well as surface catalysts that are applied to a structure through which the fuel is passed during preconditioning. In particular embodiments, the fuel is passed through a chamber that has the catalyst material disposed within it. In other embodiments, the catalyst material may be distributed throughout the flow path for through which the fuel to be pyrolyzed flows. Examples of the application of catalysts will be discussed below.

FIG. 1 schematically illustrates a cross-sectional view of one exemplary embodiment of a hybrid gas turbine engine that makes use of a PDC as a combustor. The gas turbine engine 10 has a generally longitudinally extending axis or centerline 14 that extends through the engine 10 from front to back (from left to right on FIG. 1). Flow through the exemplary engine illustrated is generally from front to back. The direction parallel to the centerline toward the front of the engine and away from the back of the engine will be referred to as the "upstream" direction, while the opposite direction parallel to the centerline will be referred to as the "downstream" direction.

The engine 10 has an outer shell, or nacelle 18, that generally defines the engine. An intake 16 is located at front opening of the nacelle 18, and flow into the engine enters through the intake 16. An exhaust, or nozzle 19 is located at the aft end of the nacelle 18. Flow exits the engine 10 from the exhaust.

A core engine 30 is disposed inside the nacelle 18 and includes a high pressure compressor 34, a combustor 36, a high pressure turbine 38. Fuel is burned in the combustor 36, and the expanding fuel products are passed through the high pressure turbine 38. The high pressure turbine 38 drives the high pressure combustor via a shaft. In one embodiment, the combustor 36 is a PDC, as described above.

The engine 10 also includes a low pressure compressor 22 and a low pressure turbine 24 that are disposed upstream and downstream respectively of the core engine 30. The low pressure turbine receives the flow exiting the high pressure turbine and extracts energy from the flow. The low pressure turbine is joined to the low pressure compressor 22 by a shaft.

A bypass duct 44 is disposed within the nacelle 18 and allows for a portion of the flow through low pressure compressor 22 to pass around the core engine 30. The bypass duct 44 flows around the support structure 48 of the core engine 30 and low pressure turbine 24. The remainder of the flow through the low pressure compressor passes into the core engine 30. The flow from the bypass duct 44, as well as the flow exiting from the low pressure turbine 24 are both passed into an augmentor 60 that is located upstream of the exhaust nozzle 19 of the engine 10. In one embodiment, the augmentor 60 may be a PDC.

To precondition the fuel prior to its use in a PDC of an engine, a fuel preconditioning system is used to achieve the desired conversion of the fuel into a more detonable form. As noted above, a pyrolysis system that applies heat to the fuel in an oxidizer-poor environment can be used to achieve the appropriate chemical decomposition of the fuel, as well as heating the fuel and partially or completely vaporizing the fuel. One such preconditioning system is described below with reference to FIG. 2.

Figure 2:
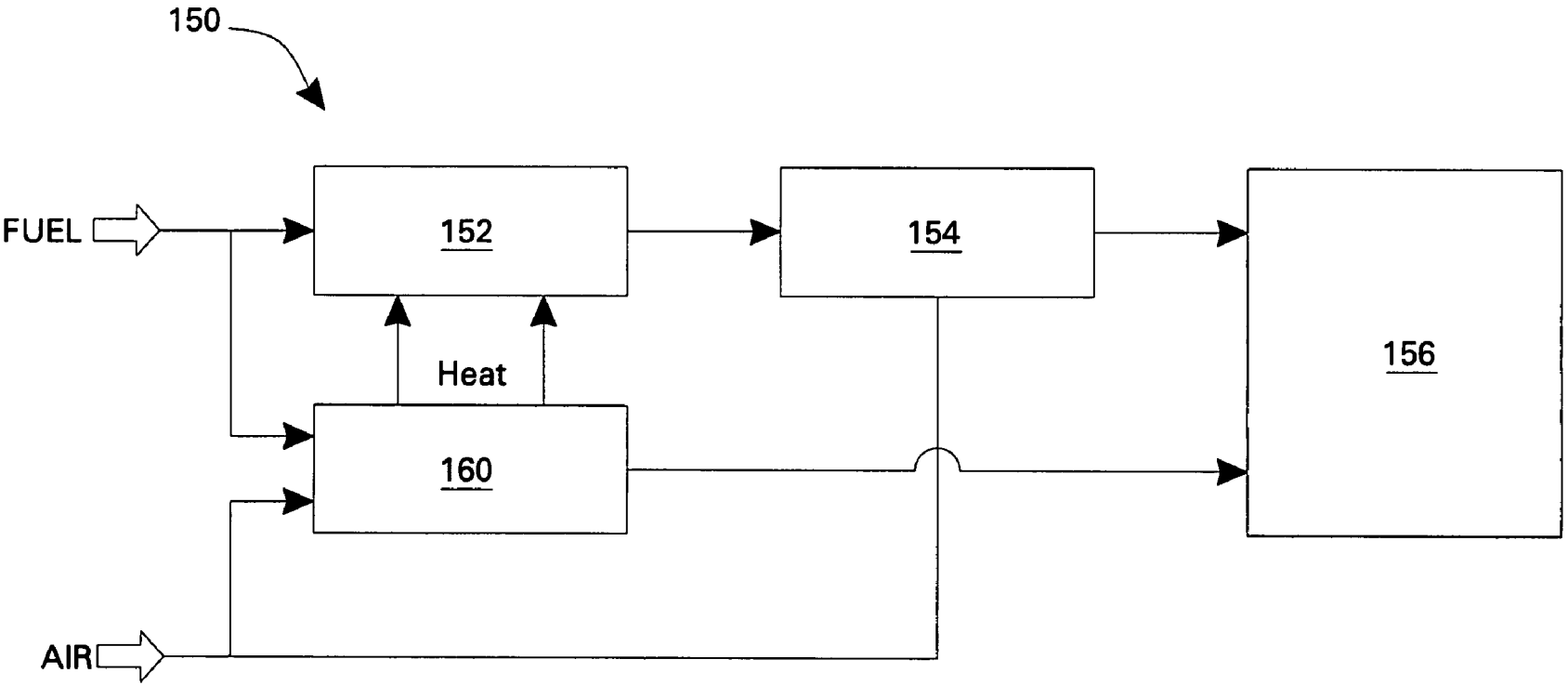
FIG. 2 is a schematic illustration of a fuel preconditioning system that may be used with the engine shown in FIG. 1.

FIG. 2 illustrates schematically a fuel preconditioning system 150 that may be used with a gas turbine engine, such as engine 10 of FIG. 1. The illustrated elements of the preconditioning system 150 may be disposed at a variety of locations within the actual engine 10, but generally, they will be disposed at some locations near to, and generally upstream of, the location of the PDC tubes in the engine. For instance, if an embodiment of engine 10 in which a PDC combustor 36 were being used, the fuel preconditioning system 150 would be disposed in such a way that it was generally located in the flow path upstream of the combustor 36. By contrast, in an embodiment of an engine 10 that used a PDC augmentor 60, the fuel preconditioning system 150 would be located upstream of the augmentor, but not necessarily upstream of the combustor.

Fuel preconditioning system 150 includes a fuel conditioner 152 and a PDC 154. As shown in the Figure, fuel that is ultimately intended to flow into the PDC 154 is passed into the conditioner 152 first, and then passes into the PDC from the conditioner. Because the flow into the PDC 154 comes from the conditioner 152, the PDC is downstream in the flow path from the conditioner, even if the conditioner is not actually located closer to the front of the engine. Fuel exiting fuel conditioner 152 is channeled to detonation chamber 154. As shown in the Figure, air is added to the preconditioned fuel in the PDC 154, and then it is detonated as described above. The exhaust products from the detonation or quasi-detonation combustion that takes place in the PDC 154 are passed to the PDC exhaust 156.

Pyrolysis of the fuel takes place in the conditioner 152. As noted above, this requires a source of heat to be applied to the fuel passing through the conditioner 152. As shown in FIG. 2, a heat source 160 may be one or more of a variety of components. In the illustrated embodiment, the heat source 160 is a burner that is thermally coupled to fuel conditioner 152. A small portion of the fuel flow to the engine 10 is fed to the burner and burned in the presence of an oxidizer, such as air, in order to produce heat that can be transferred to the fuel passing through the conditioner 152. In one exemplary embodiment, less than approximately five percent of the total fuel flow supplied towards fuel conditioner 152 is routed to the heater.

Although the heat source 160 and conditioner 152 are indicated schematically in FIG. 2, it will be understood that for effective transfer of heat from the heat source 160 to the conditioner 152, it may be desirable for these two components to be constructed in a way that they share surfaces, or that the components are intertwined with one another as known in the art to maximize the amount of heat transferred out of the heat source and into the fuel inside the conditioner 152.

In an alternative embodiment of the fuel preconditioning system, the heat source 160 need not be a burner that receives fuel from the engine's fuel supply. The heat source 160 may an existing component of the engine that has an operating temperature that is sufficiently high to pass heat to the conditioner 152. By operating using the heat rejected by a hot section of the engine, the fuel preconditioning system may simultaneously provide a cooling effect to the hot component.

Examples of such components that may operate at such temperatures include, but are not limited to: a combustor (for example the main combustor 36 if the PDC requiring conditioning is the augmentor); a compressor; an electrical system that generates waste heat; an electrical heating unit; a frictionally heated surface; or any other hot component. For such heat sources other than burners, fuel preconditioning system 150 is structured substantially as shown in FIG. 2, but there is no need to provide a source of fuel and air to the heat source 160 as shown in the Figure. Similarly, in embodiments that do not use burners, there is no need to pass exhaust gases to the PDC exhaust 156.

During operation of systems using a heat source 160, whether a burner or a hot engine component, fuel passing through the conditioner 152 is chemically converted through a pyrolysis process to a fuel that is more detonable than the fuel being supplied to fuel conditioner system 150. Heat source 160 and fuel conditioner 152 increase the temperature of the fuel such that the fuel at least partially decomposes and vaporizes to form a more detonable substance having a lower average molecular weight. Furthermore, the decomposition process causes radicals to form within the fuel that facilitate enhancing the detonation process without reducing the heating value of the fuel.

In addition to using fuel preconditioning systems 150 that rely purely on pyrolysis, as discussed above, catalysts may also be used to help condition the fuel. In one embodiment, an inner surface of fuel conditioner 152 is coated with a catalyst that facilitates enhancing decomposition reactions of the fuel. In one embodiment, the catalyst can be a zeolite having a precious metal incorporated into its structure. Suitable precious metals can include, but are not limited to: nickel, platinum and rhodium.

In addition to using the various heat sources discussed above with reference to FIG. 2, it is also possible to use the heat generated by the detonations inside a PDC itself to support the pyrolysis of the fuel to be fed to the PDC. One exemplary embodiment of a self-heating PDC will be discussed with reference to FIG. 3 below.

Figure 3:
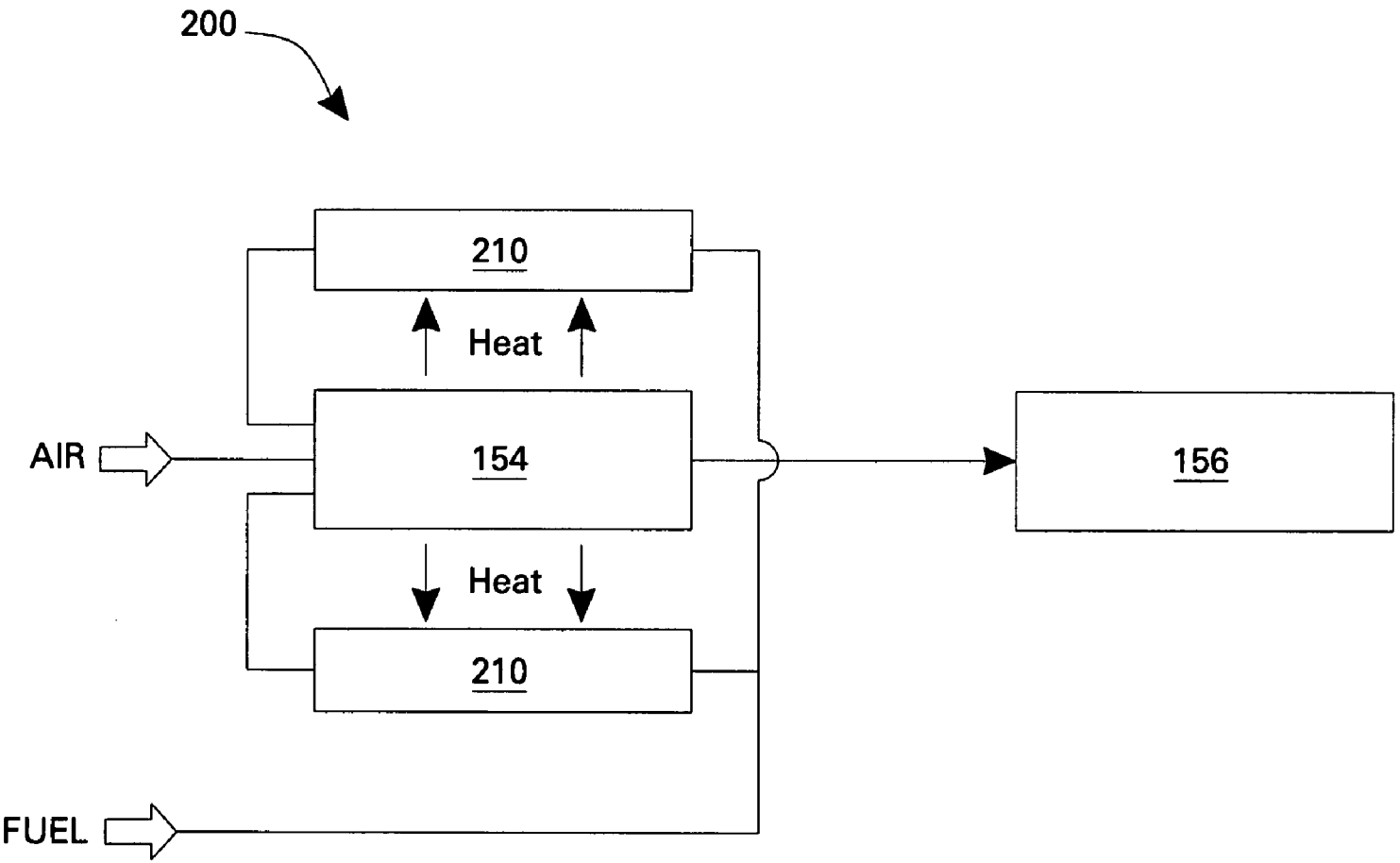
FIG. 3 is a schematic illustration of an alternative embodiment of a fuel preconditioning system that may be used with the engine shown in FIG. 1.

FIG. 3 shows a schematic illustration of an embodiment of a fuel preconditioning system 200 that may be used with engine 10 shown in FIG. 1. Similar to the embodiment of fuel preconditioning system as illustrated in FIG. 2, the fuel preconditioning system 200 of FIG. 3 includes a PDC 154, a PDC exhaust 156, as well as sources of fuel and air that are fed to the PDC.

Unlike the embodiment of FIG. 2, fuel preconditioning system 200 has one or more fuel conditioners 210 that are disposed in thermal communication with the PDC 154. Specifically, each conditioner 210 is configured as a heat exchanger to extract heat from the walls of the PDC 154 and to use this rejected heat to pyrolyze the fuel passing through the conditioner 210. After passing through the conditioner, the fuel then enters the PDC 154 for detonation or quasi-detonation as described above.

As shown in FIG. 3, in one embodiment, the conditioner 210 is a counter-flow heat exchanger; that is, the fuel flows through the conditioner 210 along the surface of the PDC 154 in a direction from the downstream end of the PDC toward the upstream end. Such a technique is may be used to maximize the amount of heat exchanged between a hot flow and a cooler flow. However, it will be understood that a variety of geometries of flow path and configuration for the conditioner 210 may be used in order to take advantage of the heating pattern expected on a particular PDC, and may provide advantages over a purely counter-flow arrangement of the conditioner 210 and PDC tube 154. Because the conditioner 210 can essentially be built into the walls or liner of the PDC tube 154, such an arrangement can be made more compact than systems that involve separate heating elements, such as shown in FIG. 2.

As noted above when discussing heat rejected from other hot engine sources, this arrangement provides for the decomposition and vaporization of the fuel into a form that is more easily detonable before air is added to the fuel and it is detonated in the PDC. As with the fuel preconditioning system 150 of FIG. 2, fuel preconditioning system 200 may also take advantage of catalysis in addition to pyrolysis for fuel decomposition and/or vaporization.

Fuel preconditioning systems such as those shown in FIGS. 2 and 3 and discussed above may be used to facilitate the detonation of fuels, particularly liquid fuels, for the operation of various types of engines. Examples of configurations making use of fuel preconditioning will be discussed briefly, below.

In one embodiment, a hybrid gas turbine engine makes use of a PDC as a combustor. In such an engine, the combustion process that takes place in combustor 36 is a detonation or quasi-detonation process. If a fuel conditioning system 150 such as that shown in FIG. 2 were used with such an engine, the PDC 154 of system 150 would also be the combustor 36 of engine 10. The conditioner 152 and heat source 160 could be disposed within the support structure 48 of the engine. The PDC exhaust 156 of the system 150 would be the flow into the high pressure turbine 38 of the core engine 30.

As noted above, heat sources 160 that might be suitable for such a hybrid engine configuration could include, but are not limited to: burners disposed in the support structure 48; the high pressure compressor 34; electrical components of the core engine 30; or such other heat sources as known in the art.

In another embodiment, the hybrid engine described above could make use of the self-preconditioning PDC system 200 described above and shown in FIG. 3. In such embodiments, the fuel would pass through the conditioner(s) 210 disposed in the support structure 48 to as to take advantage of the heat rejected by the combustor 36 (which is also the PDC 154).

Various structural arrangements for the conditioner 210 and the PDC 154 could be used. In one embodiment, the conditioner 210 can be of an annular cross-section that completely surrounds the PDC tube such that they are concentrically disposed. In such arrangements, the outer surface of the wall of the PDC tube forms the inner surface of the inner wall of the conditioner 210.

Another embodiment of a structural arrangement for the conditioner 210 and the PDC is to have the conditioner formed into a tube that is wrapped in a spiral form around the PDC 154 tube. Both this arrangement and the previous arrangement allow for the heat absorbed into the PDC tube to be directly conducted into the flow through the conditioner 210, since the conditioner and the PDC tube have common surfaces.

In yet other embodiments, a separate conditioner module 210 is disposed at a location to take advantage of heat rejected from the PDC 154 tube without being wrapped around the PDC directly. Such arrangements may have particular application when access to the PDC tube is necessary or when physical constraints limit the placement of the conditioner 210 or PDC tube.

Another embodiment of an engine could make use of an ordinary combustor 36, but use a PDC as the augmentor 60 of the engine 10 shown in FIG. 1. An augmentor is a device for producing additional thrust out of an engine by injecting fuel directly into the hot exhaust gases from the core engine. In an engine making use of a PDC augmentor 60, the augmentor would be configured to detonate the fuel in the augmentor, rather than to merely burn it.

In an embodiment of a PDC augmentor engine that used a fuel preconditioning system 150 such as shown in FIG. 2, the PDC 154 would correspond to the augmentor 60, and the PDC exhaust 156 would correspond to the nozzle 19 of the engine 10. The fuel to be injected into the PDC augmentor would pass through a conditioner 152 that could be disposed in the support structure 48 of the engine, or in the nacelle 18 structure. Heat sources 160 suitable for use in such a system can include, but are not limited to: a dedicated burner, as described above; the heat rejected from the various components of the core engine 30, including the heat rejected from the main combustor 36, as well as the compressors and turbines of the engine 10.

In another embodiment, the PDC augmentor engine described above could make use of the self-preconditioning PDC system 200 described above and shown in FIG. 3. In such embodiments, the fuel would pass through the conditioner(s) 210 disposed in the nacelle 18 structure surrounding the augmentor 60, using the heat of the exhaust flow and the PDC combustor 154 to condition the fuel prior to its injection into the augmentor 60.

Another embodiment of a system that may take advantage of the techniques and systems described herein for preconditioning fuel prior to combustion in a PDC is a pure pulse detonation engine. Such an engine does not use the compressor or turbine systems described above with reference to FIG. 1. Such systems may include a PDC tube that is configured to produce thrust directly from the expulsion of the exhaust products and the supersonic shockwaves from the engine. In essence, such a system eliminates all of the core engine 30 components of engine 10, as well as the low pressure compressor and turbine. Such pure PDE engines operate in the manner of the PDC augmentor described above, but without the use of the remaining engine components.

The engines described herein may be used for both airborne and ground-based applications. For instance, the hybrid engine with augmentor may be well suited for use on an airplane as a propulsive engine. In addition, a hybrid engine not making use of an augmentor might be suitable for power generation. In such a power generation application, the shaft connected to the low pressure turbine might be connected to a generator in order to generate electrical power. Those of skill in the art will recognize that the systems described herein can be used in most applications for which a traditional gas turbine engine is suitable.

In addition to the systems explicitly described herein, it will be understood that all of the ordinary control systems associated with gas turbine engines may be used in conjunction with the systems described. For example, systems to allow for controlling the fuel flow rate to the main engine, and systems to allow for the selective activation of the augmentor on demand may be incorporated as necessary to facilitate the operation of the systems described.

The various embodiments of fuel preconditioning systems and engines using these preconditioning systems described above thus provide a way to enhancing the detonability of fuel for combustion in a PDC. The above-described fuel preconditioning systems include at least one fuel conditioner that chemically converts fuel supplied to the preconditioning system into lighter hydrocarbon fragments via a pyrolysis process and/or a catalyst process. The pyrolyzed fuel is supplied to the detonation chamber and mixed with airflow prior to being detonated. Furthermore, the production of radicals facilitates enhancing the detonation process. As a result, engines using the fuel preconditioning system obtain increased thrust generation without the production of carbon dioxide emissions and/or water vapor.

Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

Furthermore, the skilled artisan will recognize the interchangeability of various features from different embodiments. For example, the PDC combustor described with respect to one embodiment can be adapted for use with embodiments using a PDC augmentor as well, making use of a system such as that shown in FIG. 3 to precondition the fuel for the combustor, and simultaneously using the heat rejected from the combustor to act as a heat source as shown in FIG. 2 for the augmentor. In another example, a kerosene fueled PDC may make use of a zeolite containing rhodium. The various features described, as well as other known equivalents for each feature, can be mixed and matched by one of ordinary skill in this art to construct preconditioning systems for PDCs in accordance with the principles of this disclosure.

Although the systems herein have been disclosed in the context of certain embodiments and examples, it will be understood by those skilled in the art that the invention extends beyond the specifically disclosed embodiments to other alternative embodiments and/or uses of the systems and techniques herein and obvious modifications and equivalents thereof. Thus, it is intended that the scope of the invention disclosed should not be limited by the particular disclosed embodiments described above, but should be determined only by a fair reading of the claims that follow.

What is claimed is:

1. A method for operating a pulse detonation chamber in a gas turbine engine, the gas turbine engine comprising a nacelle with an intake located at a front opening thereof to allow airflow into the gas turbine engine, and a core engine disposed inside the nacelle, said core engine including a high pressure compressor, a pulse detonation chamber, and a high pressure turbine, the gas turbine engine further comprising a low pressure compressor disposed upstream of the core engine, a low pressure turbine disposed downstream of the core engine, and an augmentor located upstream of an exhaust nozzle of the gas turbine engine, said method comprising:

routing a liquid fuel to a fuel conditioner that is coupled in flow communication upstream of the pulse detonation chamber;

using a pyrolysis process to decompose the fuel within the fuel conditioner to form combustible molecules having a lower molecular weight;

routing the decomposed fuel from the fuel conditioner to the pulse detonation chamber;

channeling a portion of the airflow entering the air intake of the gas turbine engine into the pulse detonation chamber to mix with the decomposed fuel and form a fuel/air mixture;

detonating the fuel/air mixture within the pulse detonation chamber;

bypassing a portion of the airflow entering the air intake through a bypass duct and into the augmentor; and passing exhaust flow from the core engine into the augmentor.

2. A method in accordance with claim 1 wherein routing fuel to a fuel conditioner further comprises routing the fuel through at least one of a heater and a combustor to elevate the temperature of the fuel routed to the fuel conditioner.

3. A method in accordance with claim 1 wherein routing fuel to a fuel conditioner further comprises routing the fuel through a combustor liner to facilitate raising the temperature of the fuel supplied to the fuel conditioner, while cooling the combustion system.

4. A method in accordance with claim 3 wherein the combustor liner is a liner of the detonation chamber.

5. A method in accordance with claim 1 further comprising the step of coating an inner surface of the fuel conditioner with a catalyst that facilitates enhancing pyrolysis reactions.

6. A method in accordance with claim 1 wherein the fuel conditioner facilitates enhancing the production of fuel radicals.

7. A detonation system for an aircraft engine, said detonation system comprising:

a nacelle with an intake located at a front opening thereof to allow airflow into the aircraft engine;

a core engine disposed inside the nacelle, said core engine comprising a high pressure compressor, a pulse detonation chamber for detonating an air/fuel mixture downstream of the high pressure compressor, and a high pressure turbine downstream of the pulse detonation chamber;

a fuel conditioner coupled in flow communication upstream of said pulse detonation chamber, said fuel conditioner configured to decompose liquid fuel within the fuel conditioner to form combustible molecules having a lower molecular weight; and an augmentor upstream of an exhaust nozzle, wherein exhaust gas from the pulse detonation chamber is passed through the augmentor, and wherein a portion of the airflow entering the intake is bypassed through the augmentor.

8. A detonation system in accordance with claim 7 further comprising at least one of a heater and a combustor coupled in flow communication with said fuel conditioner for heating at least a portion of fuel supplied to said gas turbine engine.

9. A detonation system in accordance with claim 7 wherein fuel is circulated as cooling fluid within a heat exchanger prior to being channeled to said fuel conditioner.

10. A detonation system in accordance with claim 7 wherein said fuel conditioner further comprises an inner surface coated with a catalyst, and said catalyst facilitates enhancing pyrolysis reactions.

11. A detonation system in accordance with claim 7 wherein said fuel conditioner facilitates enhanced detonation within said detonation chamber.

12. A detonation system in accordance with claim 7 wherein said fuel conditioner facilitates enhanced production of fuel radicals.

13. A detonation system in accordance with claim 7 wherein said fuel conditioner is coupled upstream from said detonation chamber.

14. A gas turbine engine comprising:

a nacelle with an intake located at a front opening thereof to allow airflow into the gas turbine engine;

a core engine disposed inside the nacelle, said core engine comprising a high pressure compressor, a pulse detonation chamber for detonating an air/fuel mixture downstream of the high pressure compressor, and a high pressure turbine downstream of the pulse detonation chamber;

a fuel conditioner coupled in flow communication upstream of said detonation chamber, said fuel conditioner configured to decompose liquid fuel to form combustible molecules having a lower molecular weight; and an augmentor upstream of an exhaust nozzle, wherein exhaust gas from the pulse detonation chamber is passed through the augmentor, and wherein a portion of the airflow entering the intake is bypassed through the augmentor.

15. A gas turbine engine in accordance with claim 14 wherein said fuel conditioner is further configured to facilitate enhanced detonation within said detonation chamber.

16. A gas turbine engine in accordance with claim 15 further comprising at least one of a heater and a combustor coupled in flow communication with said fuel conditioner, said at least one of a heater and a combustor for raising a temperature of fuel supplied to said fuel conditioner.

17. A gas turbine engine in accordance with claim 15 further comprising a combustion system, wherein a temperature of fuel supplied to said fuel conditioner is raised as the fuel is circulated for cooling the combustion system prior to the fuel being routed to said fuel conditioner.

18. A gas turbine engine in accordance with claim 15 wherein said fuel conditioner comprises at least one surface comprising a catalyst configured to enhance pyrolysis reactions.

19. A gas turbine engine in accordance with claim 15 wherein said fuel conditioner is further configured to enhance production of fuel radicals.

20. A gas turbine engine in accordance with claim 15 wherein an inner surface of the fuel conditioner is coated with a catalyst to enhance pyrolysis reactions.

* * * * *